US007017772B2

(12) United States Patent
Meiland et al.

(10) Patent No.: US 7,017,772 B2
(45) Date of Patent: Mar. 28, 2006

(54) PRESSURE CONTAINER

(75) Inventors: Nico J. Meiland, Racine, WI (US); Stanley J. Flashinski, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 149 days.

(21) Appl. No.: 10/388,244

(22) Filed: Mar. 13, 2003

(65) Prior Publication Data

US 2003/0178432 A1 Sep. 25, 2003

Related U.S. Application Data

(60) Provisional application No. 60/367,408, filed on Mar. 25, 2002.

(51) Int. Cl.
*B65D 6/28* (2006.01)
*B65D 8/08* (2006.01)
*B65D 8/04* (2006.01)

(52) U.S. Cl. ..... 220/613; 220/612

(58) Field of Classification Search ..... 220/611, 220/612, 613, 581, 583, 662, 62.11, 62.22, 220/DIG. 14, 906, 610; 215/12.2, 325
See application file for complete search history.

(56) References Cited

U.S. PATENT DOCUMENTS

| | | | | |
|---|---|---|---|---|
| 2,753,088 | A * | 7/1956 | Prahl, Jr. | 222/215 |
| 3,081,906 | A * | 3/1963 | Henchert | 220/615 |
| 3,221,954 | A | 12/1965 | Lux | 222/566 |
| 3,506,151 | A * | 4/1970 | Barge | 215/325 |
| 4,464,109 | A * | 8/1984 | Giangiulio et al. | 431/344 |
| 4,561,555 | A * | 12/1985 | Miller | 220/611 |
| 4,591,066 | A * | 5/1986 | Moen | 220/634 |
| 4,795,045 | A | 1/1989 | Radtke | 215/325 |
| 6,068,900 | A * | 5/2000 | Kohn et al. | 428/35.7 |
| 6,077,578 | A * | 6/2000 | Valyi | 428/35.7 |
| 6,484,900 | B1 | 11/2002 | Stiner et al. | 220/662 |

FOREIGN PATENT DOCUMENTS

| | | | |
|---|---|---|---|
| DE | 1121092 | 1/1962 | 17/3 |
| GB | 2101225 A | 1/1983 | |

* cited by examiner

*Primary Examiner*—Nathan J. Newhouse
*Assistant Examiner*—Harry Grosso

(57) ABSTRACT

A pressure container comprising axially extending side walls formed of plastic extending between a top end and a bottom end. A metal top is attached at a top seam in pressure-containing relation to the top end of the side walls, and a metal bottom attached at a bottom seam in pressure-containing relation to the bottom end of the side walls. Optional top and bottom beads are formed in the side walls to aid in sealingly securing the metal top and bottom to the side walls. A method for containing pressurized materials by providing and filling such a pressure container is also shown.

18 Claims, 3 Drawing Sheets

PRESSURE CONTAINER

CROSS-REFERENCE TO RELATED APPLICATIONS

This application claims priority based on U.S. provisional application 60/367,408, which was filed Mar. 25, 2002.

STATEMENT REGARDING FEDERALLY SPONSORED RESEARCH/DEVELOPMENT

Not applicable

FIELD OF THE INVENTION

The present invention relates to containers that are particularly adapted for containing pressurized materials including, but not limited to, pressurized gases either alone or in combination with liquids, gels, or other materials commonly dispensed under pressure from containers.

BACKGROUND OF THE INVENTION

There are a variety of known bottles and cans designed to contain pressurized materials. These include metal cans, such as those commonly used in conventional aerosol products, as well as plastic bottles, such as those commonly used for containing pressurized beverages. At least in laboratory settings, it is also known to use glass bottles to contain the sort of materials that, in the consumer market, are normally dispensed from metal cans.

It is also known to use plastic bottles with a dispensing valve for pressurized aerosol products. FIG. 1 shows an example of such a prior art bottle. It is unitarily formed and includes a plastic bottom 1, plastic side walls 2, and a plastic top 3 that is necked in to create a bottle mouth 4. An appropriate valve 5 (shown schematically in half-round) is then mounted in the bottle mouth.

The bottle mouth 4 has a radially extending rim 6, and such valves 5 have a downwardly extending skirt 7 that is crimped under the rim 6, as shown in FIG. 1. A sealing layer 8 is sometimes located on the top-most surface of the rim 6, sealing the valve 5 to the rim to retain pressure within the bottle. The sealing layer 8 can be either a resilient gasket or a layer of a sealant material.

The use of plastic containers for products has various advantages, including such things as allowing a user to see the contained product before purchase or to monitor product consumption and condition. However, such prior art plastic bottles have several shortcomings. Most are manufactured by a blow-molding process, in which a slug or pre-form of hot, soft plastic is inserted within a mold and then expanded with a compressed gas, such as air, to conform to the interior of the mold. A "slug" here refers simply to a mass of plastic.

A "pre-form" is typically a thick-walled plastic piece that may be formed by injection molding or other processes to have predictable dimensions. In blow molding, both slugs and pre-forms are heated and inserted within the mold before being expanded with compressed gas.

The result of blow molding can be a bottle of consistent external dimensions. Furthermore, it is even possible to so prepare the initial slug or pre-form that it includes successive layers of different plastics, resulting in a final bottle that has laminated walls. This is commonly done, for example, when an inexpensive plastic is used for the exterior layers of a bottle, forming the bulk of the bottle's structure. The exterior layers are co-formed with one or more internal, laminated layers of functionally different plastics.

The internal layers may be necessary because of their ability, for example, to seal in and retain pressurized gases that otherwise would migrate and escape through the plastic of the outer layer. Conventional plastic soft drink and catsup bottles are made with multiple layers to successfully contain those products.

However, the blow-molding process is inherently less precise in controlling wall thickness and features than are other techniques for molding plastics. This presents an increasing problem when it is desired to contain materials at increasing pressures. At some point, flaws or other weaker bottle locations will give way, causing bottle failure even though most of the bottle is still strong enough to contain the pressure.

In contrast to blow molding, the well known injection molding process can produce structures of very precise dimensional consistency. In injection molding, a mold is provided that defines all the surfaces of the object to be produced, including both exterior and interior surfaces. As a result, structure thickness and other features are not dependent on the vagaries of an initial slug of hot plastic, expanding under pressure. However, it is very difficult, and in many instances entirely impractical, to produce via injection molding a unitarily formed bottle with a necked-in top. There is no way to withdraw through the necked-in top the part of the mold that defines the bottle's larger internal shape.

As an alternative the art has proposed non-unitary manufacture of such bottles, creating first an open-bottomed, injection-molded bottle and then, secondarily, attaching a plastic bottom. See, for example, U.S. Pat. No. 5,346,659. (The disclosure of this patent and all other publications referred to herein are incorporated herein by reference as if fully set forth.) These means of manufacture require special equipment and also leave one or more plastic-to-plastic seams that can be points of inconsistent thickness or plastic crystal structure or other structural inconsistencies that can lead to an increased likelihood of failure under sufficiently challenging pressures.

By whatever technique they are formed, plastic bottles having cylindrical sides, a plastic bottom, and a necked-in plastic top tend to fail under pressure first at the necked-in top or the bottle bottom. Various strategies have been employed to counter this, including designing pressure-resisting shapes for bottoms and thickened walls in bottle tops or other means to strengthen plastic tops.

Some of the resulting bottle shapes require separate, additional bottom structures to allow, for example, a rounded bottle bottom to rest on a flat surface without tipping over. For an example of such a conventional structure, see in FIG. 1 the base cap 9. The ability to rest stably on a flat surface is important both in use and in handling the bottle in conventional filling lines and other manufacturing situations.

Even with these special shapes, however, bottle failure still can occur as a consequence of the limitations of blow molding or plastic-to-plastic seams, especially when less expensive and less strong plastics such as polyethylene terephthalate (commonly referred to as "PET") are used to make the pressure-resisting structure and bulk of the bottle. While considerable bottle strength can be achieved even in conventional plastic bottles by use of more expensive, stronger plastics, such as polyethylene naphthalate (commonly referred to as "PEN"), the expense can be prohibitive if the bottle is intended for use with a product that cannot be sold competitively at a higher price.

Incidentally, commercial materials referred to in the art (e.g. and in this patent) as "PET", "PEN", or the like typically are primarily the plastic referred to, but may also include small amounts of other plastics added to adjust molding or other characteristics of the primary plastic. The nature of such minor additions is well understood in the art.

The art has also developed a number of containers made of a mix of materials to hold a variety of chemicals. See e.g. U.S. Pat. No. 4,561,555 (plastic side wall, metal top), U.S. Pat. No. 4,464,109 (plastic side wall, metallic cap), U.S. Pat. No. 2,686,081 (two different plastic sections), U.S. Pat. No. 2,476,446 (plastic side wall, metal collar), U.S. Pat. No. 2,753,088 (plastic side wall, metal end) and U.S. Pat. No. 3,685,684 (mixed plastic metal can). However, even these prior art approaches are not optimal when one tries to form the plastic main body in a blow molding process where inexpensive, preferably transparent, plastics are used.

It can therefore be seen that there is a need for an improved container for pressurized materials that combines the advantages of inexpensive and transparent plastic materials with the strength, reliability, and ease of handling of a conventional metal can.

SUMMARY OF THE INVENTION

The invention provides a pressure container (preferably an aerosol pressure container) that has axially extending side walls formed of plastic. The side walls extend between a top end and a bottom end. A metal top is attached at a top seam in pressure-containing relation to the top end of the side walls, and a metal bottom is attached at a bottom seam in pressure-containing relation to the bottom end of the side walls.

If desired, the metal top may be equipped with the features of a conventional aerosol can. This can include a peripheral edge (conventionally referred to as the can's chime), the structure that typically curves upwardly and inwardly from the chime to form the can's dome, and a valve cup attached to the dome, suitable for receiving a valve.

In one preferred embodiment the side walls are essentially straight and are cylindrical with a side wall maximum diameter. The side walls are made without any radially inward, plastic extensions at the top or bottom ends that extend inwardly for more than the amount that decreases the side wall diameter by 20 percent of the side wall maximum diameter, and preferably by no more than 15 percent or, even more preferred, by no more than 8 percent. The top metal part has an upwardly tapering region extending above the side walls.

In this form, the "neck" or narrowing aspect of the device is preferably achieved essentially solely within via a metal portion of the design, with little or no inward bending of the upper end of the plastic side wall.

The smaller such inward extension, the more pressure-resistant the container. As a consequence of this limitation, the pressure containment problems associated with plastic bottles that are more deeply necked in to form a bottle mouth can be avoided. The weak point of the plastic section is thus avoided.

The side walls may be made using blow molding or other conventional manufacturing techniques. Alternatively the side walls can be manufactured by an extrusion or an injection molding process, to achieve an even higher consistency of side wall thickness, strength, and plastic crystal structure and orientation. By either extrusion or injection molding methods, dimensional tolerances can be achieved in high volume production processes in which wall thicknesses vary by no more than three to five percent.

As shown in FIG. 2, the metal side walls of conventional metal aerosol cans are sometimes folded back on themselves at the point of attachment to either a can top or bottom. Such a folded-back arrangement can also be used at the bottom or top seams of the pressure container of the invention. However, when, in accordance with the invention, plastic side walls replace the prior art metal side walls, the plastic side walls can be made (e.g. via injection molding) with an enlarged bulbous bead formed integrally with the side walls (either at the top of the wall, or at the bottom, or at both). The bead can bulge inwardly from the wall, or outwardly from the wall, or both ways.

The metal bottom of the present invention, which preferably includes at its periphery a bottom clamping rim that embracingly encloses and seals against the bottom end of the side walls, can then grasp and seal against the bottom bead. The result is an improved bottom seam compared to a bottom seam in which an entirely straight-walled bottom end or even a folded bottom end must be grasped by the bottom clamping ring.

Similarly, when the side walls are made by an injection molding process, the side walls can include at their top end a top bead that is formed integrally with the remainder of the side walls and is thicker than the adjacent portion of the side walls. The metal top, which preferably includes at its periphery a top clamping rim that embracingly encloses and seals against the top end of the side walls, can then grasp and seal against the top bead.

The result is an improved top seam compared to a top seam in which an entirely straight-walled top end or even a folded top end must be grasped by the top clamping ring. The top bead can be so molded or otherwise made as to extend radially only inwardly from the side walls or, alternatively, can include, either instead or in addition, portions that extend radially outwardly from the side walls.

When the side walls are made by an injection molding process and the side walls have a side wall maximum diameter, the side walls can include at their top end a necked-in portion ending at the top seam. In one aspect of the invention the necked-in portion extends radially inwardly from the side wall maximum diameter sufficiently that the top seam is entirely inward of the side wall maximum diameter. But the necked-in portion may extend radially inwardly for no more than the amount that decreases the side wall diameter by 20 percent of the side wall maximum diameter, and preferably by no more than 15 percent or, even more preferred, by no more than 8 percent. The less the extent of necking-in, the more pressure-resistant the container. A reduction in side wall diameter due to the necking is preferably about 8 percent to avoid the seam from catching on the manufacturing line, and a further reduction to about 15 percent permits an over cap to be used without causing problems of the seam or cap catching on the production line.

A top bead, entirely comparable to the top bead discussed above, may also be provided, forming a part of the necked-in portion. The top bead is thicker than the adjacent parts of the necked-in portion, with the metal top then including at its periphery a top clamping rim that embracingly grasps and seals against the top bead to form the top seam.

Preferably the side walls of the pressure container of the invention include a primary pressure-containing layer that is made of a plastic selected from the group consisting of PET, PEN, polycarbonate, polyacrylamide, and mixtures thereof.

In addition to the primary pressure-containing layer, the side walls can beneficially include at least one modifying plastic layer made of a plastic different from that of the primary pressure-containing layer.

In a preferred embodiment, the modifying plastic layer is internal to the primary pressure-containing layer and is made of a plastic selected from the group consisting of PEN, nylon, EVOH (ethylene vinyl alcohol co-polymer), acrylonitrile methyl acrylate copolymers (such as BAREX® copolymers sold by BP Chemicals), and mixtures thereof. When having two or more layers, it is preferred that the side walls of the pressure container of the invention be made by either blow molding or co-extrusion, although co-extrusion is preferred for the advantages already disclosed.

A method of the invention calls for containing pressurized materials by the following steps. First, plastic side walls are manufactured, the side walls formed so as to extend axially between a top end and a bottom end. A metal top is provided that is attachable to the side walls' top end at a top seam in pressure-containing relation, the metal top having an opening.

A metal bottom is provided that is attachable to the side walls' bottom end at a bottom seam in pressure-containing relation. The metal top and metal bottom then are attached to the side walls' top and bottom ends, respectively, in pressure-containing relation to form a pressure container. The pressure container is filled with desired contents, and the opening in the metal top is closed in a pressure-containing manner, either before or after imparting pressure to the contents.

The step of manufacturing the side walls may include any of several alternative or additional steps. For example, the manufacturing step can be accomplished by means of an extrusion process or an injection molding process. The side walls may beneficially be manufactured so as to have at least two layers formed of different plastics. Beads, necked-in portions, and other physical features, as described above, may beneficially be included in the side walls.

However, it is important in the step of manufacturing the side walls that, when the side walls are formed with a side wall maximum diameter, no radially inward extensions at the top or bottom ends extend inwardly for more than the amount that decreases the side wall diameter by 20 percent of the side wall maximum diameter, and preferably by no more than 15 percent.

Preferably, the step of manufacturing the side walls includes manufacturing them with a primary pressure-containing layer made from a plastic selected from the group consisting of PET, PEN, polycarbonate, polyacrylamide, and combinations thereof.

Thus, the invention achieves the goat of a pressure resistant container that can be inexpensively produced from inexpensive plastic and conventional can metal. The can structure is particularly suited for automated manufacture.

The foregoing and other advantages of the present invention will appear from the following description. In the description reference is made to the accompanying drawings which form a part thereof, and in which there is shown by way of illustration, and not limitation, preferred embodiments of the invention. These embodiments do not represent the full scope of the invention. Rather, reference should therefore be made to the claims herein for interpreting the scope of the invention.

DETAILED DESCRIPTION OF THE INVENTION

Figure 3:
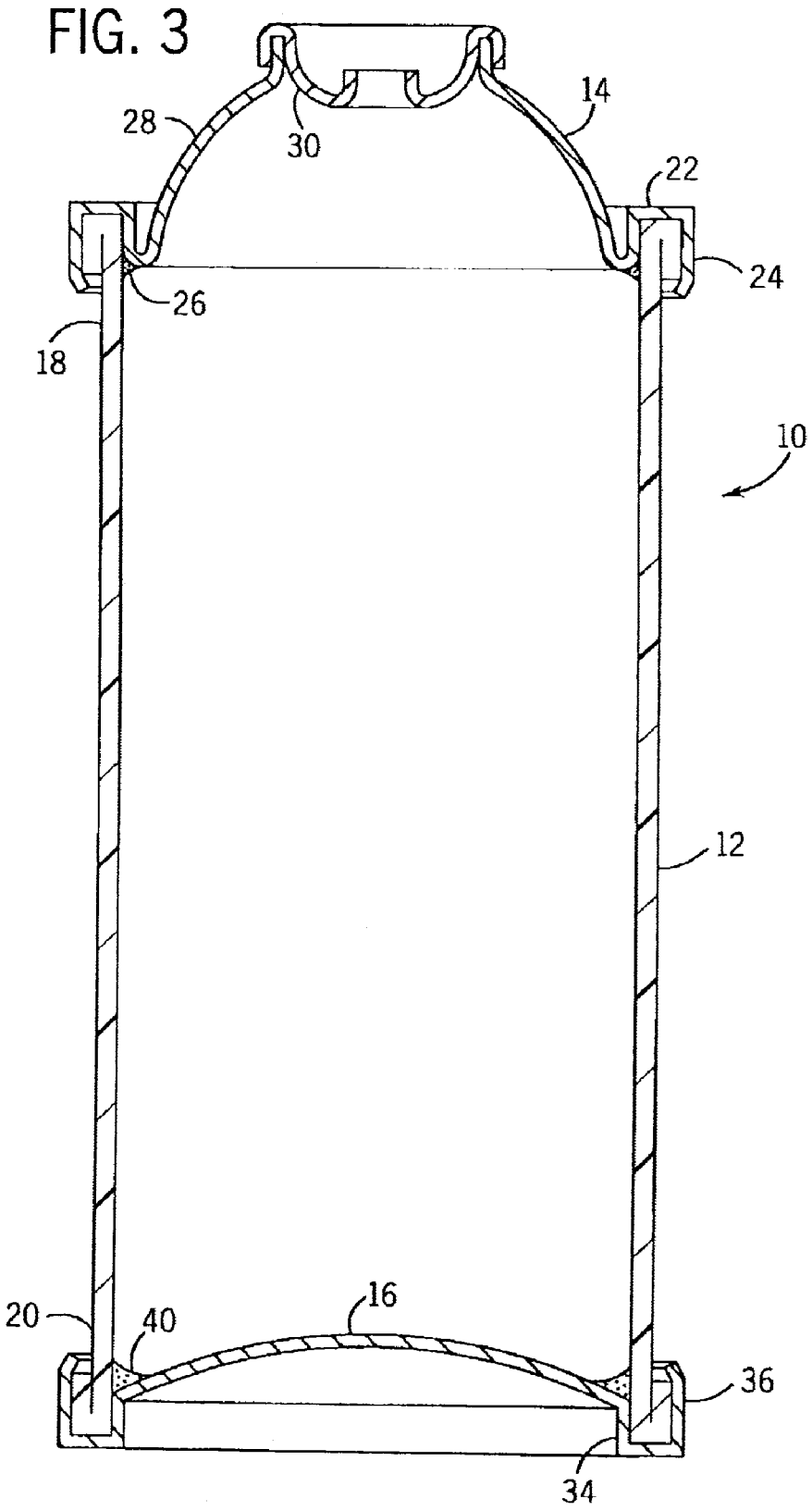
FIG. 3 is a cross-sectional view of a first embodiment of the present invention.

Turning now to the drawings, wherein like and corresponding reference numbers refer to analogous corresponding parts throughout the several views, in a first embodiment of the present invention a pressure container is shown generally at 10 in FIG. 3. The pressure container 10 has side walls 12, a metal top 14, and metal bottom 16. The side walls 12 are made of a selected plastic, which may be selected to be transparent, translucent, or opaque.

Transparent side walls 12 are preferred in that they allow container contents to be displayed to a user, and also show a user something about the condition, color, amount, and the like regarding the contents. Preferably, the side walls 12 are made of a plastic selected from the group consisting of PET, PEN, polycarbonate, polyacrylamide, and mixtures thereof.

The side walls 12 extend axially and have a top end 18 and a bottom end 20. The metal top 14 is attached to the top end 18 of the side walls 12 in pressure-containing relation at a top seam 22. Preferably the metal top 14 has at its periphery a top clamping ring 24. The top clamping ring 24 has opposing surfaces that embracingly hold, pinched between them, the top-most portion of the top end 18 of the side walls 12.

In manufacturing conventional, all-metal aerosol cans (e.g. FIG. 2), such structures are crimped in place at the top end of a can by means well known in the aerosol can-making art, and comparable manufacturing steps and means can be used with the pressure container 10 of the invention. A sealant 26 can be employed at the top seam 22 to help ensure a pressure-tight seal. Preferred sealants are high temperature pressure adhesive sealant materials such as those based on silicones, cyanoacrylates, and urethanes. Alternatively, the sealant 26 may be made of rubber or other gasket materials.

However, by selection of a plastic material for the side walls 12 that at least slightly compresses beneath the pressure of a crimped top clamping ring 24, the sealant 26 becomes a less critical for most pressure conditions, and may even be omitted when the pressure to be contained is modest. If the pressure container 10 is to be used in a manner comparable to that of conventional aerosol cans, the metal top 14 may include a dome 28, valve cup 30, valve (not shown), and all other structures associated with such cans.

The metal bottom 16 is attached to the bottom end 20 of the side walls 12 in pressure-containing relation at a bottom seam 34. Preferably the metal bottom 20 has at its periphery a bottom clamping ring 36. The bottom clamping ring 36 has opposing surfaces that embracingly hold, pinched between them, the bottom-most portion of the bottom end 20 of the side walls 12.

Figure 1:
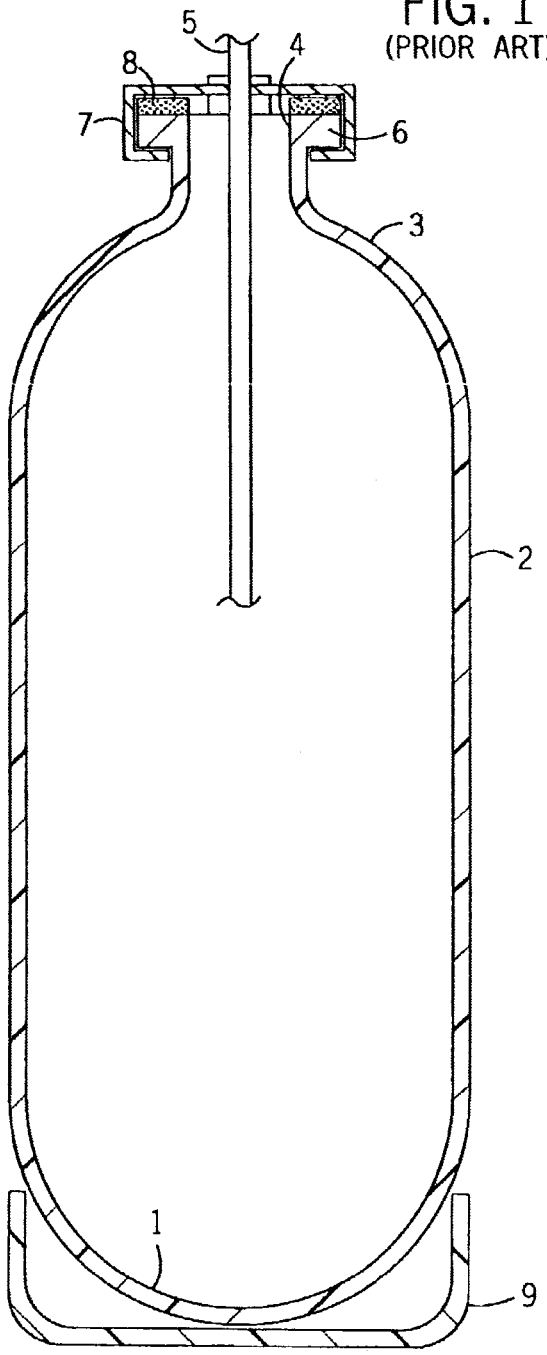
FIG. 1 (PRIOR ART)
FIG. 1 is a cross-sectional view of a prior art plastic pressure bottle.
Figure 2:
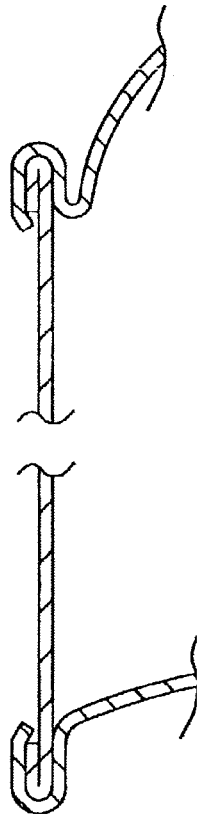
FIG. 2 (PRIOR ART)
FIG. 2 is a cross-sectional view of broken away portions of a prior art all-metal aerosol can.

As with the metal top of the FIG. 2 structure, the metal top 14 in FIG. 3 can be crimped in place at the bottom end of a can by means well known in the aerosol can-making art, and comparable manufacturing steps and means again can be used with the pressure container 10 of the invention. For example, as with the top seam 22, a sealant 40 can be employed at the bottom seam 34 to ensure a pressure-tight seal. The sealant 40 can be the same as the sealant 26. Again, by selection of a plastic material for the side walls 12 that at least slightly compresses beneath the pressure of a crimped bottom clamping ring 36, the sealant 40 becomes a less vital and sometimes can be omitted.

Figure 4:
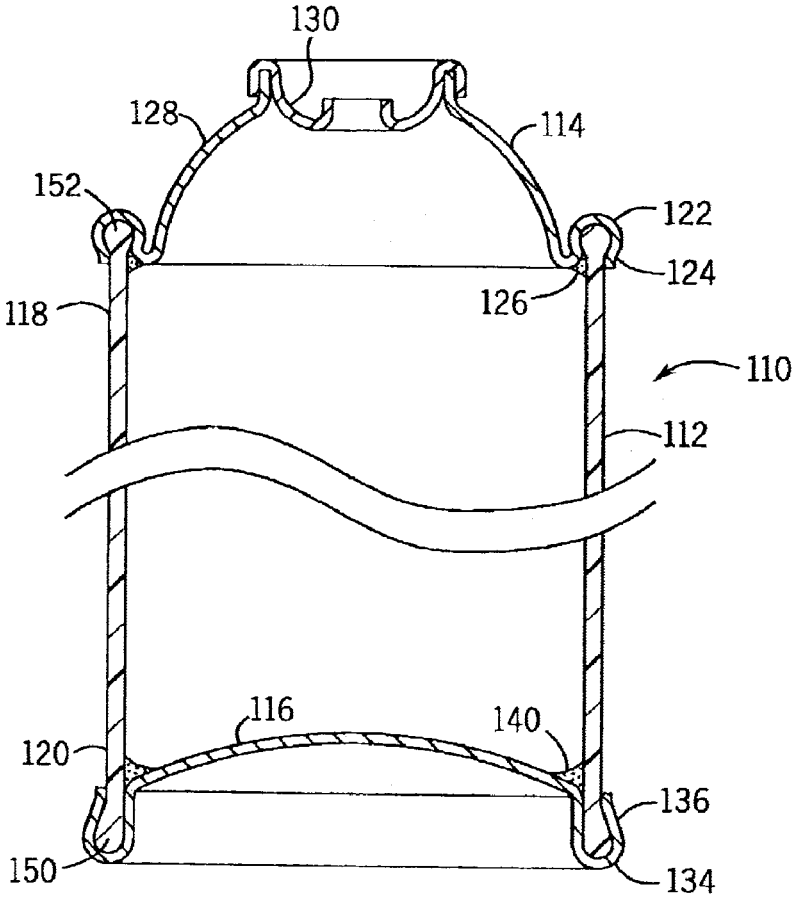
FIG. 4 is a cross-sectional view of a second embodiment of the present invention.

In a more preferred form, structures are provided in the FIG. 4 embodiment 110 which help reduce the need for such sealants and gaskets still further. Features of the FIG. 4 embodiment that are analogous to the FIG. 3 embodiment features are given similar numbers, albeit indexed by 100. We are not discussing some of these separately in the context of FIG. 4. However, a cross reference to the discussion of FIG. 3 will assist in understanding the structure further.

In any event, the side walls 112 of the FIG. 4 pressure container 110 differ from the corresponding structure of the pressure container shown at 10 in FIG. 3 in that they include at least one of a bottom bead 150 at the side walls' bottom end 120 and at least one top bead 152 at the side walls' top end 118. Alternatively, there could either be just one top bead but no bottom bead, or just one bottom bead but no top bead. However, having both beads is highly preferred.

Side walls 112 have such features that are best made by a conventional injection molding process. The bottom and top beads 150,152 each are thicker than the adjacent portions of the side walls 112 and are integrally formed therewith. These are well suited for injection molding formation.

When crimped into place, the bottom clamping ring 136 curves back toward the remainder of the metal bottom 116 such that the distance between the periphery of the bottom clamping ring and the remainder of the metal bottom is less than the thickness of the bottom bead 150, which helps to secure the metal bottom to the side walls 112. The bottom clamping ring 136 of the metal bottom 116 thus curves around, grasps, and seals against the bottom bead 150.

The result is an improved bottom seam 134 compared to a bottom seam in which an entirely straight-walled or even a folded-back bottom end must be grasped by a bottom clamping ring. The bottom bead 150 as shown extends radially only outwardly from the side walls 112. However, it will be apparent that a bottom bead can, alternatively, include, either instead or in addition, portions that extend radially inwardly from the side walls (compare bead 152).

The features and mode of interaction of the top bead 152 and the top clamping ring 124 of the metal top 114 can entirely correspond to those of the bottom bead 150 and metal bottom 116, just described. To illustrate an alternative structure, the top bead 152 is shown as including portions that extend radially inwardly from the sidewalls.

Figure 5:
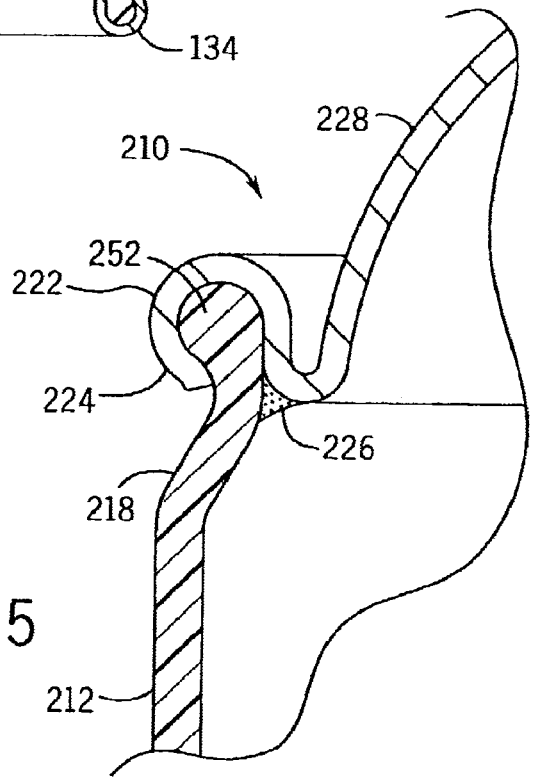
FIG. 5 is a cross-sectional view of a broken away portion of a third embodiment of the present invention.

An additional, even more preferred, embodiment of the pressure container of the invention is shown generally at 210, in FIG. 5. Again, analogous parts are identified with analogous numbers, albeit indexed by 200. Again, some of these features are not discussed separately with respect to the FIG. 5 embodiment. However, cross reference to the FIG. 3 discussion (and/or the FIG. 4 discussion) will be of assistance in further understanding the FIG. 5 embodiment.

When the side walls 212 have a side wall maximum diameter, the side walls can include at their top end 218 a necked-in portion 254, ending at the top seam 222. The necked-in portion 254 extends radially inwardly from the side wall maximum diameter sufficiently that the top seam 222 is entirely inward of the side wall maximum diameter. But, in order to avoid the structural defects that lead to top failures in conventional plastic bottles, the necked-in portion 254 should extend radially inwardly for no more than the amount that decreases the side wall diameter by 20 percent of the side wall maximum diameter, and preferably by no more than 15 percent or, even more preferred, by no more than 8 percent.

Some necking in is highly preferred to prevent the seam or associated over cap from snagging on conveyor parts during assembly or packing. Thus, we have discovered a narrow range of necking which minimizes structural issues, while avoiding these snagging concerns.

Top bead 252 forms a part of the necked-in portion 254. An entirely corresponding necked-in portion (not shown) may be employed at the bottom end of the pressure container as well.

Comparable, necked-in portions are utilized in conventional, all-metal cans. However, applicants are not aware of any art showing such structures combined with the use of plastic side walls 212, either with or without the top and bottom beads, size limitations, and the other distinguishing features and structures disclosed above, all of which further depart from the all-metal can art.

Preferably the side walls of the pressure container of the invention include a primary pressure-containing layer that is made of a plastic selected from the group consisting of PET, PEN, polycarbonate, polyacrylamide and mixtures thereof. In addition to the primary pressure-containing layer, the side walls can beneficially include at least one modifying plastic layer made of a plastic different from that of the primary pressure-containing layer.

In a preferred embodiment, the modifying plastic layer is internal to the primary pressure-containing layer and is made of a plastic selected from the group consisting of PEN, nylon, EVOH (ethylene vinyl alcohol co-polymer), acrylonitrile methyl acrylate copolymers (such as BAREX® copolymers sold by BP Chemicals), and mixtures thereof. When having two or more layers, it is preferred that the side walls of the pressure container of the invention be made by a co-extrusion process.

The method of the invention for containing pressurized materials includes the following steps. First, plastic side walls are manufactured having the features of a selected embodiment, as described above. A metal top, as described above, is provided that is attachable to the side walls' top end at a top seam in pressure-containing relation, the metal top having an opening. A metal bottom is provided, as described above, that is attachable to the side walls' bottom end at a bottom seam in pressure-containing relation.

The metal top and metal bottom then are attached to the side walls' top and bottom ends, respectively, in pressure-containing relation to form a pressure container. The pressure container is filled with desired contents, and the opening in the metal top is closed in a pressure-containing manner, either before or after imparting pressure to the contents. Preferably, the metal top is so designed as to function as an aerosol can top, as described, above.

The step of manufacturing the side walls can include any of several alternative or additional steps. Thus, preferably the manufacturing step is accomplished by means of an extrusion process or an injection molding process to achieve highly uniform and predictable side wall thicknesses and physical characteristics, avoiding the weak spots that can lead to container failure in blow-molded bottles. The side walls may beneficially be manufactured so as to have at least two layers formed of different plastics.

Beads, necked-in portions, and other physical features, as described above, may beneficially be included in the side walls. However, it is important in the step of manufacturing the side walls that, when the side walls are formed with a side wall maximum diameter, no radially inward extensions at the top or bottom ends extend inwardly for more than the amount that decreases the side wall diameter by 20 percent of the side wall maximum diameter, and preferably by no more than 15 percent or, even more preferred, by no more than 8 percent.

The preceding description is merely of preferred embodiments of the invention. One skilled in the art will readily apprehend alternative embodiments that nevertheless fall within the scope and breadth of the invention. Thus, the claims should be looked to in order to understand the full scope of the invention.

INDUSTRIAL APPLICABILITY

An improved pressure container is shown, along with its method of manufacture and use, that is suitable for practical industrial application to aerosol and other pressure-dispensed products.

The invention claimed is:

1. A pressure container comprising:

a. axially extending side walls formed of plastic extending between a top end and a bottom end, wherein the side walls include at their top end a top bead that is thicker than the adjacent portion of the side walls and extends radially outward therefrom;

b. a metal top attached at a top seam in pressure-containing relation to the top end of the side walls, the top seam being between the metal top and top end of the side walls; and c. a metal bottom attached at a bottom seam in pressure-containing relation to the bottom end of the side walls;

wherein the side walls have at their top end a necked-in portion contacting an end of the metal top and extending to the top seam and a side wall maximum diameter below the necked-in portion, the necked-in portion extending radially inwardly from the side wall maximum diameter sufficiently that the top seam is entirely inward of the side wall maximum diameter, and the end of the metal top is also entirely inward of the side wall maximum diameter and below the top bead; and wherein the side walls extend radially inwardly for no more than the amount that decreases the side wall diameter by 20 percent of the side wall maximum diameter.

2. The pressure container of claim 1, wherein the side walls are manufactured by an extrusion process.

3. The pressure container of claim 1, wherein the side walls are manufactured by an injection molding process.

4. The pressure container of claim 3, wherein the side walls include at their bottom end a bottom bead that is thicker than the adjacent portion of the side walls, and the metal bottom includes at its periphery a clamping rim that encloses and seals against the bottom bead to form the bottom seam.

5. The pressure container of claim 4, wherein the bottom bead extends radially outwardly from the side walls.

6. The pressure container of claim 3, wherein the metal top includes at its periphery a clamping rim that encloses and seals against the top bead to form the top seam.

7. The pressure container of claim 1, wherein the necked-in portion extends radially inwardly for no more than the amount that decreases the side wall diameter by 15 percent of the side wall maximum diameter.

8. The pressure container of claim 7, wherein the necked-in portion extends radially inwardly for no more than the amount that decreases the side wall diameter by 8 percent of the side wall maximum diameter.

9. The pressure container of claim 1, wherein, at the top end of the side walls, the top bead is provided forming a part of the necked-in portion that is thicker than the adjacent parts of the necked-in portion, and the metal top includes at its periphery a clamping rim that encloses and seals against the top bead to form the top seam.

10. The pressure container of claim 1, wherein the side walls include a primary pressure-containing layer that is made of a plastic selected from the group consisting of PET, PEN, polycarbonate, polyacrylamide, and mixtures thereof.

11. The pressure container of claim 10, wherein the side walls include, in addition to the primary pressure-containing layer, at least one modifying plastic layer made of a plastic different from that of the primary pressure-containing layer.

12. The pressure container of claim 11, wherein a modifying plastic layer is internal to the primary pressure-containing layer and is made of a plastic selected from the group consisting of PEN, nylon, EVOH, acrylonitrile methyl acrylate copolymers, and mixtures thereof.

13. The pressure container of claim 11, wherein the side walls are made by a co-extrusion process.

14. The pressure container of claim 1, wherein the side walls are cylindrical below the necked-in portion.

15. The pressure container of claim 14, wherein the side walls are without any radially inward extensions at the top or bottom ends that extend inwardly for more than the amount that decreases the side wall diameter by 15 percent of the side wall maximum diameter.

16. The pressure container of claim 15, wherein the side walls are without any radially inward extensions at the top or bottom ends that extend inwardly for more than the amount that decreases the side wall diameter by 8 percent of the side wall maximum diameter.

17. The pressure container of claim 1, wherein the container is an aerosol pressure container.

18. The aerosol pressure container of claim 17, wherein the side walls also have an enlarged bulbous bottom end.

* * * * *